US008220385B2

(12) United States Patent
Sato

(10) Patent No.: US 8,220,385 B2
(45) Date of Patent: Jul. 17, 2012

(54) STENCIL PRINTING MACHINE

(75) Inventor: Taichi Sato, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 499 days.

(21) Appl. No.: 12/301,880

(22) PCT Filed: Mar. 28, 2007

(86) PCT No.: PCT/JP2007/056570

§ 371 (c)(1),
(2), (4) Date: Nov. 21, 2008

(87) PCT Pub. No.: WO2007/141951

PCT Pub. Date: Dec. 13, 2007

(65) Prior Publication Data

US 2010/0242756 A1 Sep. 30, 2010

(30) Foreign Application Priority Data

May 26, 2006 (JP) ..... 2006-146669

(51) Int. Cl.
*B41L 13/00* (2006.01)

(52) U.S. Cl. ..... 101/116; 101/114

(58) Field of Classification Search ..... 101/114, 101/116–120

See application file for complete search history.

(56) References Cited

U.S. PATENT DOCUMENTS

| | | | | |
|---|---|---|---|---|
| 5,090,310 | A * | 2/1992 | Motoe | 101/114 |
| 5,133,919 | A | 7/1992 | Hasegawa et al. | |
| 5,323,706 | A * | 6/1994 | Sugawara | 101/483 |
| 5,901,645 | A * | 5/1999 | Takahashi et al. | 101/114 |
| 6,067,901 | A * | 5/2000 | Takahashi | 101/114 |
| 6,634,287 | B2 * | 10/2003 | Mizutani et al. | 101/114 |
| 7,971,528 | B2 * | 7/2011 | Kagawa | 101/116 |
| 2002/0040655 | A1 | 4/2002 | Mizutani et al. | |

FOREIGN PATENT DOCUMENTS

| | | |
|---|---|---|
| JP | 61-031763 U | 2/1986 |
| JP | 6-040138 A | 2/1994 |

(Continued)

OTHER PUBLICATIONS

English machine translation of JP 2005-153477, Jun. 2005.*

(Continued)

*Primary Examiner* — Ren Yan
(74) *Attorney, Agent, or Firm* — Buchanan Ingersoll & Rooney PC

(57) ABSTRACT

In a stencil printing machine including a plate discharge device for stripping a master from a plate cylinder and collecting the master after attaching the master subjected to plate making to the plate cylinder for printing on a sheet, the plate discharge device includes a storing section for storing the master, a lid for closing the storing section to be opened/closed freely, and a device for locking the lid in a closed state, the plate discharge device being provided such that it can be taken out to the housing of the stencil printing machine. Consequently, a stencil printing machine from which the plate discharge device can be taken out while secrecy is kept surely can be provided.

1 Claim, 7 Drawing Sheets

FOREIGN PATENT DOCUMENTS

| | | | |
|---|---|---|---|
| JP | 9-142001 | A | 6/1997 |
| JP | 2828479 | B2 | 9/1998 |
| JP | 2002-086882 | A | 3/2002 |
| JP | 2003-136825 | A | 5/2003 |
| JP | 2005-153474 | A | 6/2005 |
| JP | 2005-153477 | A | 6/2005 |
| JP | 2006-110893 | | 4/2006 |

OTHER PUBLICATIONS

International Search Report for PCT/JP2007/056570, completed May 8, 2007 (in Japanese).

Supplementary European Search Report issued in corresponding Application No. 07740008.3-2304 dated Nov. 9, 2009.

* cited by examiner

STENCIL PRINTING MACHINE

BACKGROUND OF THE INVENTION

1. Field of the Invention

The present invention relates to a stencil printing machine and, in particular, to a stencil printing machine having a function of maintaining confidentiality of a used master (stencil sheet).

2. Description of the Background

In a stencil printing machine, a master wound like a roll is pulled out and a content of an original manuscript is transferred onto the master by thermal perforation (plate making) with using a thermal head. The master subjected to the plate making is wound around a plate drum (stencil plate mounting body) and an ink is supplied to a perforated portion in the master. A printing paper sheet is then pressed against the master so that the content of the master is transferred onto the printing paper sheet. The master after the printing process, that is used master, is stripped from the plate drum by a plate ejecting device immediately before performing of the next plate making process. The used master is stored in an ejected plate box or the like in the printing machine. When a predetermined amount of the used masters have been stored, the masters are taken out of the ejected plate box or the like to the outside of the printing machine and discarded in a trash box or the like.

However, since the master used in the stencil printing machine has the content of the original manuscript transferred thereon by the perforation, it is possible to read the content even though the master is the used one. Therefore, though the content of the master requires confidentiality, there is a possibility that the secret is disadvantageously leaked to a third party or the like who has obtained the used master. Consequently, various stencil printing machines having functions of maintaining confidentiality which prevents reading the content of the master have been conventionally proposed.

As a conventional functions of maintaining confidentiality, there have been known the following techniques. In a technique (Patent Documents 1 to 3), a master is shrunk or melted by heating so that the master gets into an unreusable state. In a technique (Patent Documents 4 and 5), the mask is physically damaged by a sharp protrusion so that the master gets into an unreusable state. In a technique (Patent Document 6), a perforated portion is filled by applying a resin onto the surface of the master so that the master gets into an unreusable state.

In addition, there has been known the following technique. In a technique (Patent Document 7), a door of a printing machine housing an ejected plate box is bolted so that the used master is not freely taken out.

In the case of the techniques (Patent Documents 1 to 6) with performing processes such as heating, damaging, and the like for the used master, it is necessary to newly provide a device for performing the processes, and this naturally leads to increases in size, a number of parts and cost of an overall printing machine.

On the other hand, in the case of the technique (Patent Document 7) in which the door of the printing machine is bolted, since only the addition of a lock is required, it is possible to restrain increases in size, the number of parts, and cost.

However, in a stencil printing machine, since a plate drum and an ejected plate box are normally disposed adjacent to each other. Thus, when a jam occurs in the portion of the plate drum, it is necessary to take out the ejected plate box from the printing machine to fix the jam. Further, When the door of the printing machine is bolted, it is necessary to unbolt the door every time the jam occurs. Therefore, there have been problems that fixing the jam becomes very complicated and the functions of maintaining confidentiality can not be exercised during fixing the jam.

Patent Document 1: Japanese Patent Number No. 2828479

Patent Document 2: Japanese Laid-Open Patent Publication. No. 9-142001

Patent Document 3: Japanese Laid-Open Patent Publication No. 2002-86882

Patent Document 4: Japanese Laid-Open Patent Publication No. 6-40138

Patent Document 5: Japanese Laid-Open Patent Publication No. 2005-153474

Patent Document 6: Japanese Laid-Open Patent Publication No. 2003-136825

Patent Document 7: Japanese Laid-Open Utility Model Publication No. 61-31763

An object of the present invention is to provide a stencil printing machine in which, when a jam or the like occurs, a plate ejecting device can be easily taken out of the printing machine in a state where confidentiality is reliably maintained.

SUMMARY OF THE INVENTION

The present invention is characterized in that, in a stencil printing machine including, in a casing thereof, a plate ejecting device for stripping a used stencil sheet from a stencil plate mounting body and collecting the sheet, wherein the plate ejecting device comprises a storage section for storing the stencil sheet, a lid body for closing the storage section openably and closably, and a bolting means for bolting the lid body in a closed state, and the plate ejecting device is provided so as to be externally removable from the casing.

In accordance with the present invention, the stencil sheet can not be taken out of the plate ejecting device by bolting the lid body with the bolting means, e.g., even though the plate ejecting device is taken out of the stencil printing machine in order to fix the jam of the stencil sheet for the stencil plate mounting body. That is, the plate ejecting device can be taken out of the stencil printing machine in a state where the function of maintaining confidentiality is exercised. In addition, an operation such as fixing the jam or the like can be easily performed, since it is not necessary to bolt the door of the stencil printing machine. Furthermore, the present invention never leads to increases in size, a number of parts and cost of an overall printing machine, since the confidentiality is maintained by a simple means such as bolting the lid body.

EXPLANATIONS OF LETTERS AND NUMERALS

Figure 1:
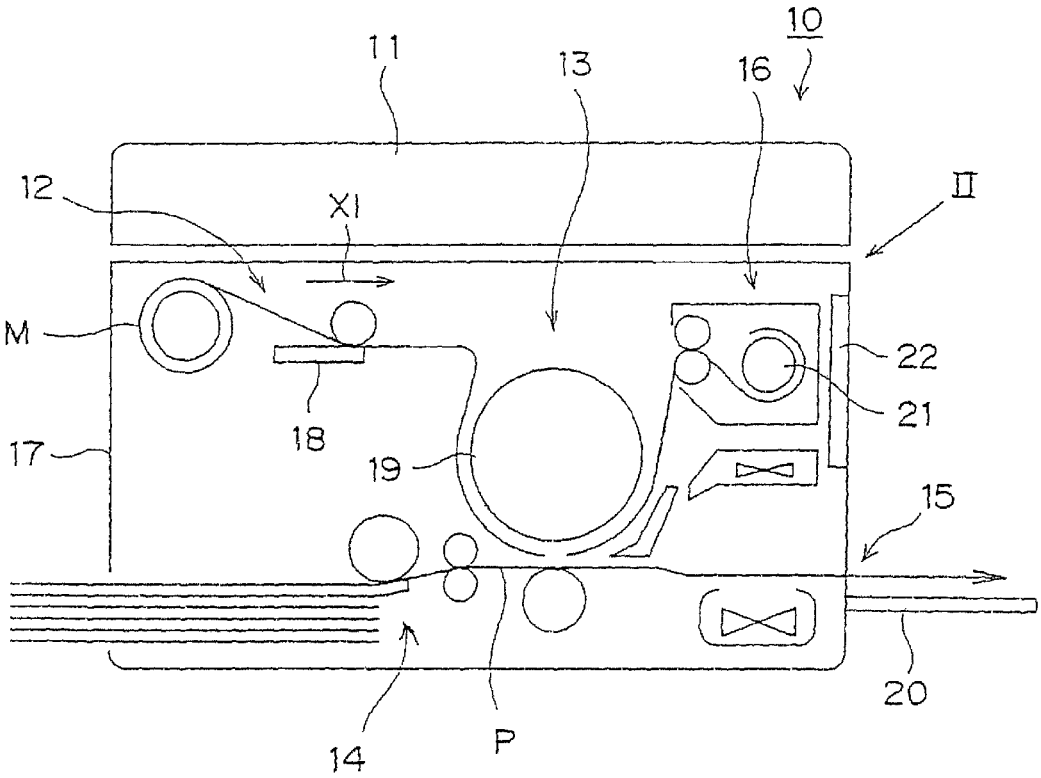
FIG. 1 is a front view schematically showing a stencil printing machine in accordance with an embodiment of the present invention.

10 stencil printing machine
16 plate ejecting device
17 casing
19 plate drum (stencil plate mounting body)
23 storage section
24 lid body
25 bolting means

BEST MODE FOR CARRYING OUT THE INVENTION

[Principal Structure of Stencil Printing Machine]

FIG. 1 is a front view schematically showing a stencil printing machine 10 in accordance with an embodiment of the present invention. The stencil printing machine 10 is configured to include an image reading device 11, a plate making device 12, a printing device 13, a sheet feeding device 14, a sheet discharging device 15, a plate ejecting device 16, and so on, in a casing (printing machine main body) 17.

The image reading device 11 reads an image of an original manuscript placed on the original manuscript platform and produces image data. The plate making device 12 pulls out a master (stencil sheet) M wound like a roll and records the image data of the original manuscript produced by the image reading device 11 on the master M by thermal perforation with using a thermal head 18 (plate making). The printing device 13, which is disposed adjacent to the plate making device 12, winds one master M made by plate making around a cylindrical plate drum (stencil plate mounting body) 19 and supplies an ink to the master M, whereby prints a printing paper sheet P fed by the sheet feeding device 14.

The sheet feeding device 14 takes out the printing paper sheet P one by one, from the printing paper sheets P stacked in layers, transports the sheet with using a transport roller or the like, and supplies the sheet under the plate drum 19. The sheet discharging device 15 strips the printing sheet P after printing from the plate drum (master M), and transfers the sheet to eject it onto a tray 20 on the outside of the printing machine. The plate ejecting device 16, which is disposed adjacent to the printing device 13, strips the used master M in the printing from the plate drum 19, and collects and stores the master M by winding it around a winding core 21. This plate-ejecting operation is normally performed in order to remove the used master M in the previous printing from the plate drum 19 immediately before the plate making is newly started.

Each of the devices is collectively controlled by a controlling means, which includes a CPU and a memory, on the basis of an operational input by an operator. An arrow X1 in FIG. 1 indicates a transport direction of the master M.

The master M used in the present embodiment is obtained by laminating a thermoplastic resin film material which is composed of, e.g., a polyester resin film material, a polyethylene resin film material, a polyvinyl dichloride resin film material or another resin film material, and an ink-permeable supporting body such as Japanese paper, nonwoven cloth or the like. However, the master made only of the thermoplastic resin film material may also be used.

Figure 2:
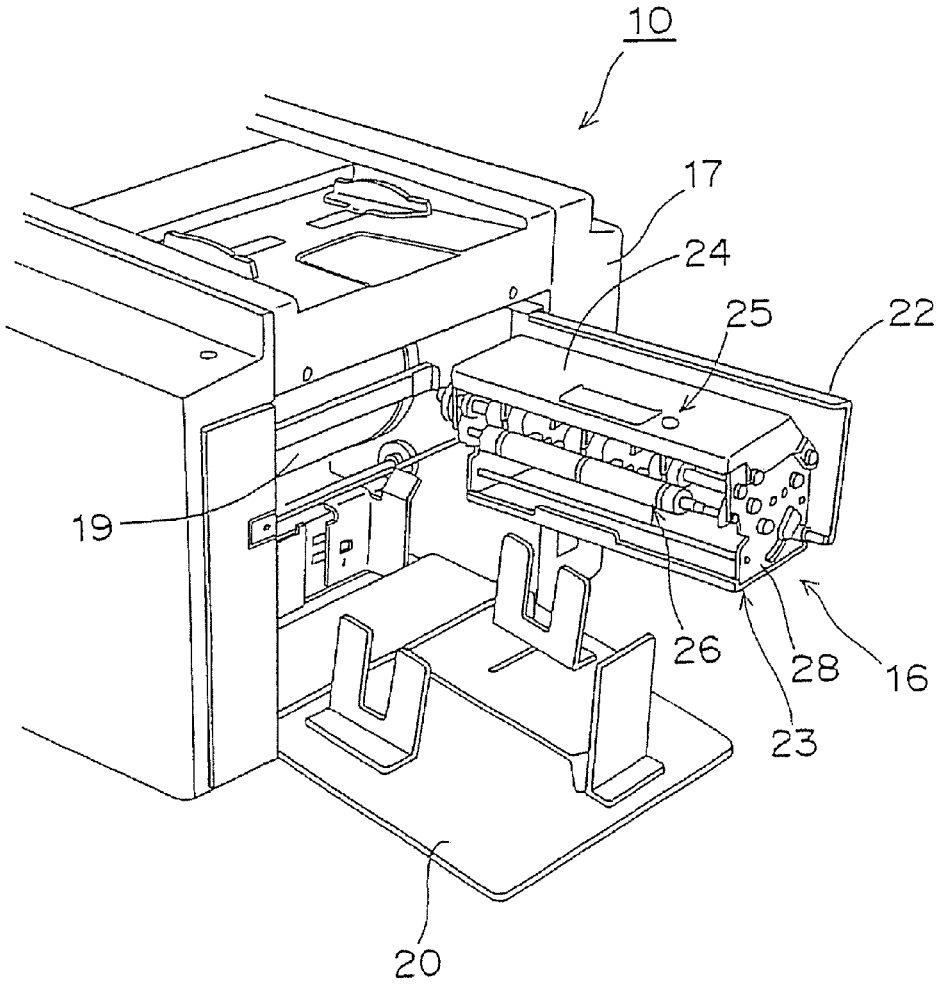
FIG. 2 is a perspective view of the stencil printing machine viewed from a direction of a view of an arrow II (obliquely upper right direction) of FIG. 1.

FIG. 2 is a perspective view showing the stencil printing machine 10 when viewed from a direction of a view of an arrow II (obliquely upper right direction) of FIG. 1. A freely openable/closable door 22 is provided on the upper portion of the side surface in the casing 17 of the stencil printing machine 10, and the tray 20 of the sheet discharging device 15 is provided under the door 22. The plate ejecting device 16 is mounted on the inside of the door 22. The plate ejecting device 16 is housed in the casing 17 by closing the door 22, and can be taken out of the casing 17 by opening the door 22.

When the plate ejecting device 16 is taken out of the casing 17 by opening the door 22, the plate drum 19 is exposed on the side surface in the casing 17. Therefore, when a jam of the master M occurs in the portion of the plate drum 19, fixing the jam can be easily performed by opening the door 22 without the disturbance of the plate ejecting device 16.

[Structure of Plate Ejecting Device 16]

Figure 3:
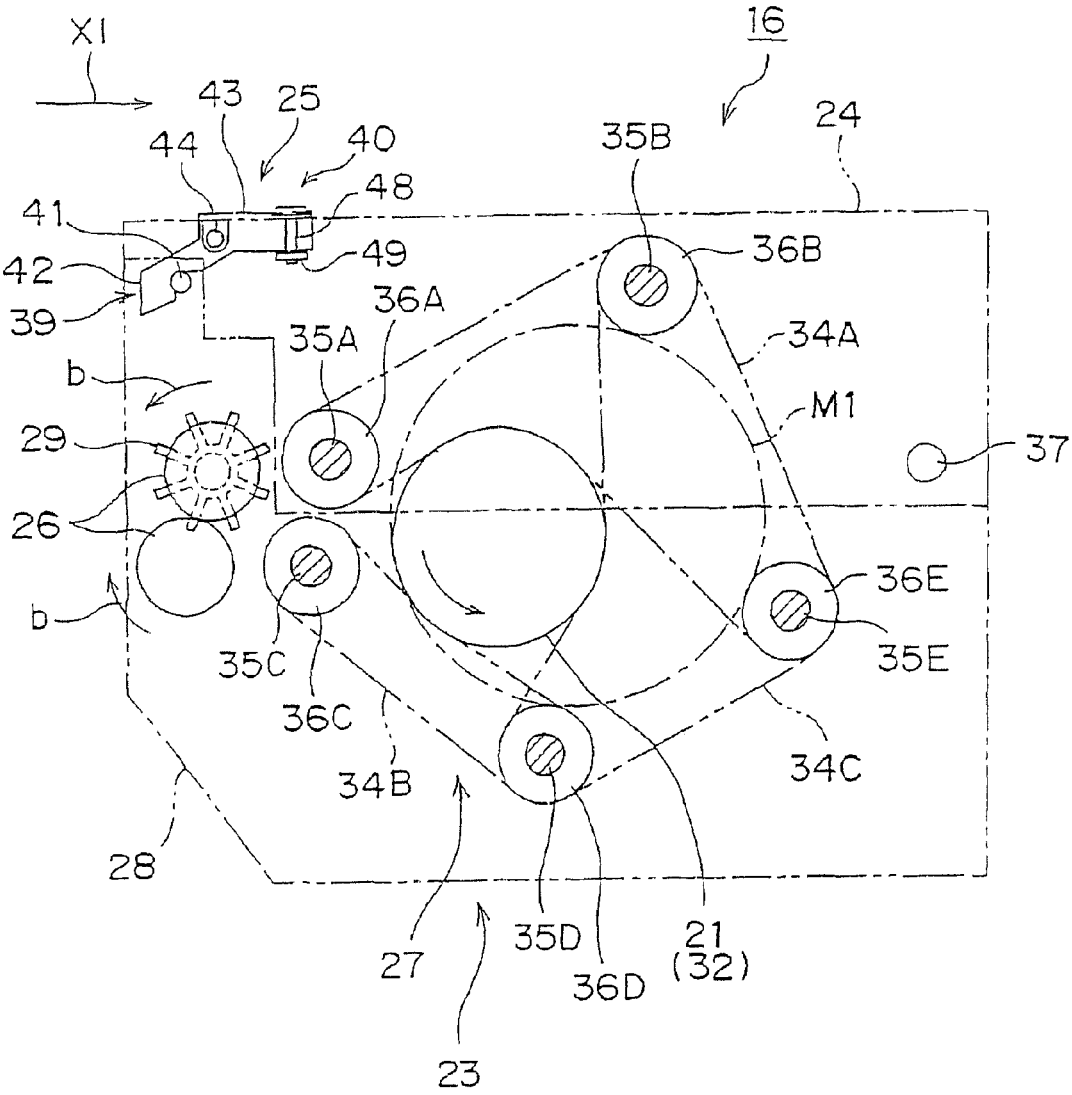
FIG. 3 is a schematic front view of a plate ejecting device.
Figure 4:
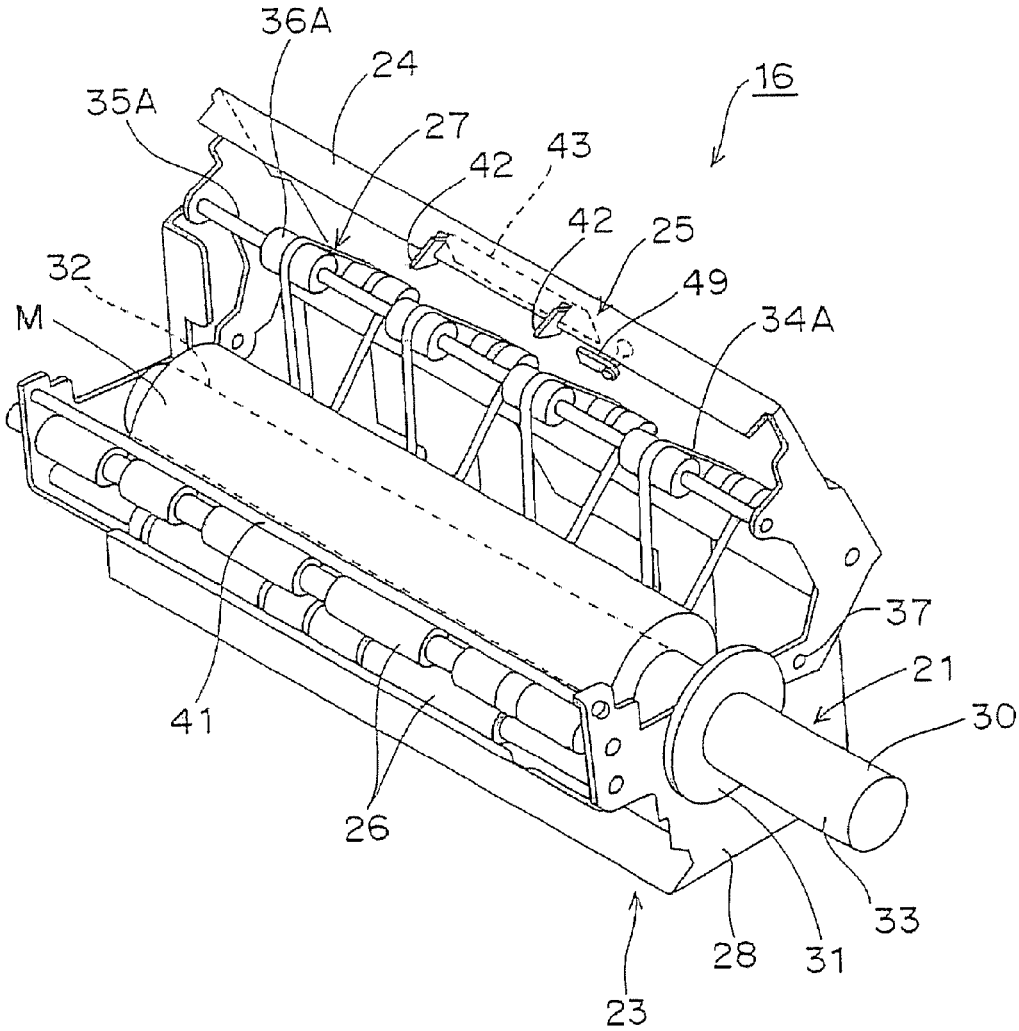
FIG. 4 is a perspective view of the plate ejecting device.

FIG. 3 is a schematic front view of the plate ejecting device 16, while FIG. 4 is a perspective view of the plate ejecting device 16. The plate ejecting device 16 includes a storage section 23 for storing a used master, a lid body 24 for closing the storage section 23 openably and closably, and a bolting means 25 for bolting the lid body 24 in a closed state. Further, the storage section 23 includes introduction rollers 26, a winding core 21, a supporting means 27 for the winding core 21, a device frame 28, and the like.

The introduction rollers 26 are for stripping a used master M from the plate drum (FIG. 1) and transporting it to the winding core 21. The introduction rollers 26 of one pair of upper and lower are provided on the upstream side in a transport direction X1 of the device frame 28. The introduction rollers 26 of upper and lower hold the used master M therebetween, and rotate in a direction of an arrow b to transport the used master M to the side with the winding core 21. The upper introduction roller 26 is coaxially provided with a importing roller 29 radially having a plurality of vanes.

As shown in FIG. 4, the winding core 21 includes a flanged portion 31, which protrudes radially outwardly at a position closer to one end portion of a cylindrical core rod 30 and protrudes like a shape of a disk. With the flanged portion 31 serving as a boundary, the longer side of the core rod 30 serves as a winding portion 32 for winding the master M, while the shorter side serves as a handle 33 for the winding core 21.

As shown in FIG. 3, the supporting means 27 has a structure in which a plurality of supporting belts 34A to 34C support the winding core 21. The supporting means 27 includes a plurality of supporting shafts 35A to 35E (five shafts in an example of the drawing) disposed so as to surround the winding core 21, supporting pulleys 36A to 36E attached to each of the supporting shafts 35A to 35E, and the plurality of supporting belts 34A to 34C wound around the supporting pulleys 36A to 36E. Lower three supporting shafts 35C to 35E are supported on the side with the device frame 28, while upper two supporting shafts 35A and 35B are supported on the side with the lid body 24.

The supporting belts 34A to 34C include the belt 34A which is wound over the three supporting pulleys 36A, 36B, and 36E, the belt 34B is wound over the two supporting pulleys 36C and 36D, and the belt 34C is wound over the three supporting pulleys 36B, 36E, and 36D. Each of the supporting belts 34A to 34C is elastically composed of an elastic belt, a coil spring, and the like. The winding portion 32 of the winding core 21 is supported by being held between the supporting belts 34A to 34C. An external diameter is increased by winding the master M around the winding core 21. For example, when the external diameter of the master M reaches an external diameter M1 which is indicated by the dot-dash line in FIG. 3, each of the supporting belts 34A to 34C can stretch to maintain the supporting state. It is to be noted that the supporting pulleys 36A to 36E and the supporting belts 34A to 34C are plurally provided in an axial direction so that the winding core 21 is supported at plural positions in the axial direction.

The winding core 21 can be rotated by a rotation driving section which is not shown. The rotation driving section transmits rotation power of an electric motor or the like to the supporting shafts (e.g., the supporting shafts 35C and 35E) of the supporting means 27. Thereby The rotation driving section can drive each of the supporting belts 34A to 34C and rotate the winding core 21 held between the supporting belts 34A to 34C.

The lid body 24 is disposed in such a manner as to cover the device frame 28 from above. One side portion (a downstream side in the transport direction X1) of the lid body 24 rotatably supported by the supporting shaft 37 on the device frame 28. Therefore, by making the lid body 24 rotate upward with the supporting shaft 37 as a pivot, the device frame 28 (the storage section 23) is opened and the winding core 21 can be taken out. Conversely, by making the lid body 24 rotate downward, the device frame 28 is closed and the winding core 21 can not be taken out. FIG. 4 shows a state where the lid body 24 is opened.

Figure 5:
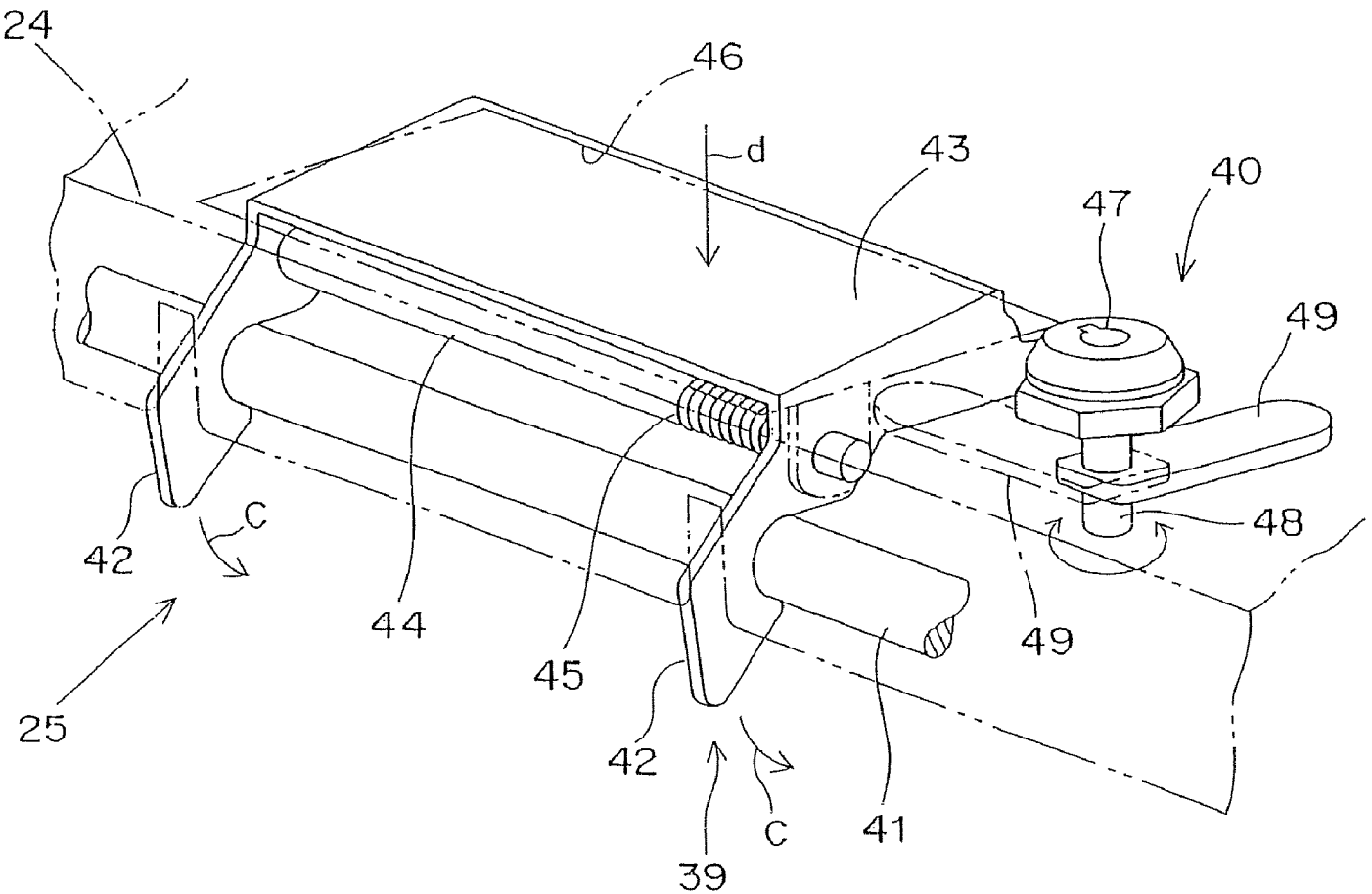
FIG. 5 is a perspective view showing a bolting means in enlarged relation.

FIG. 5 is a perspective view showing the bolting means 25 in enlarged relation. The bolting means 25 has a locking mechanism 39 for locking the lid body 24 to be in the closed state, and a bolting section 40 for bolting the lid body 24 by maintaining a locked state by means of the locking mechanism 39. About the locking mechanism 39, a engaged bar (engaged member) 41 is build in the upper portion of the device frame 28 (FIG. 3). and engaging hooks 42 (engaging member) for engagement with the engaged bar 41 and an operation lever 43 for detaching the engaging hooks 42 from the engaged bar 41 are provided in the lid body 24.

The engaging hooks 42 and the operation lever 43 are integrally formed, and the middle portion between both is rotatably supported on the lower side of the lid body 24 via a installation shaft 44. The engaging hooks 42 are biased toward a direction of the engagement with the engaged bar 41 (arrow c) by an biasing member 45 such as a coil spring or the like. The operation lever 43 is disposed so as to be exposed from an rectangular opening 46 which is formed in the upper surface of the lid body 24. By pressing the operation lever 43 toward a direction of an arrow d to swing the lever 43 downward, the engaging hooks 42 rotates upward (counter direction to c direction) about the installation shaft 44 and detaches from the engaged bar 41, thereby locking is released.

The bolting section 40 is configured to rotate a key shaft 48 which vertically extends and to rotate a key piece 49 which is fixed to the lower portion of the key shaft 48 together with the key shaft 48 by inserting a key (not shown) into a key hole 47 provided in the upper surface of the lid body 24 and turning the key.

When the key piece 49 is in a state indicated by the solid line in FIG. 5, the bolting section 40 is in an unbolted state. When the key piece 49 is in a state indicated by the dot-dash line, the bolting section 40 is in a bolted state. In the bolted state, the key piece 49 is positioned under the operation bar 43 so that a downward swing of the operation bar 43 is regulated. Consequently, the engaging hooks 42 can not be detached from the engaged bar 41 so that the locked state of the lid body 24 is maintained.

When the lid body 24 is bolted by the bolting means 25 described above, a used master M can not be taken out of the plate ejecting device 16, even though the door 22 is opened and the plate ejecting device 16 is taken out of the casing 17 as shown in FIG. 2. Therefore, the master is not stolen accidentally while the door 22 is opened.

When the amount of the master M stored in the plate ejecting device 16 reaches the maximum value, the door 22 is opened and the bolting means 25 is unbolted to open the lid body 24, as shown in FIG. 4.

Subsequently, the wound master M is taken out of the device frame 28 together with the winding core 21. Subsequently, the master M is removed from the winding core 21 and a process for maintaining confidentiality (heating or physical damaging of the master M or the like) is performed as needed. Subsequently, the master M is discarded. Thereafter, the winding core 21 is mounted in the device frame 28 again, and the lid body 24 is closed and bolted in the closed state by the bolting means 25.

The bolting of the lid body 24 can be performed not only when printing requiring the maintenance of the confidentiality is performed but also when normal printing is performed. When the maintenance of the confidentiality is not required at all, the lid body 24 may be kept as not to be bolted.

[Another Embodiment]

The present invention is not limited to the embodiment described above, and modifications and changes in designing may be appropriately made. For example, the present invention may be implemented in a manner as follows.

Figure 6:
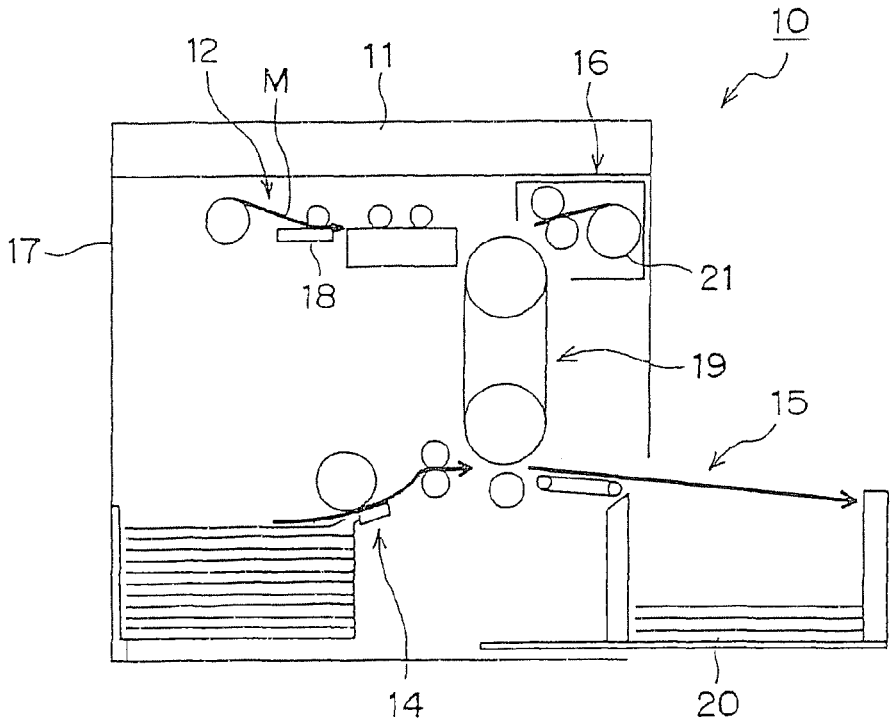
FIG. 6 is a front view schematically showing a stencil printing machine in accordance with another embodiment of the present invention.
Figure 7:
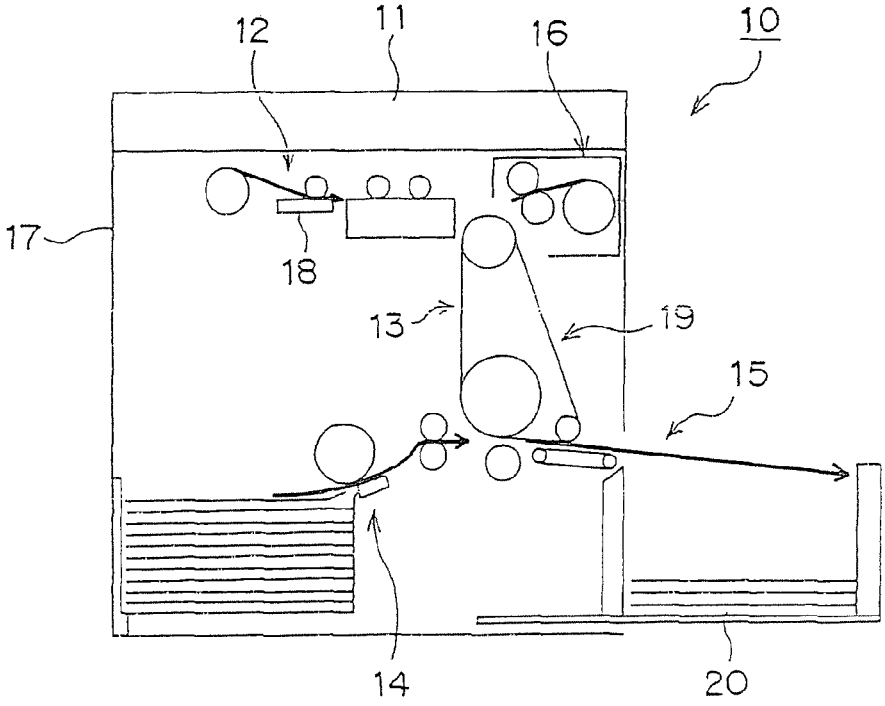
FIG. 7 is a front view schematically showing a stencil printing machine in accordance with still another embodiment of the present invention.

(1) The plate drum 19 of the stencil printing machine 10 is not limited to a single-drum type in the embodiment described above, and multiple-drum types shown in FIGS. 6 and 7 may be adopted.

Figure 8:
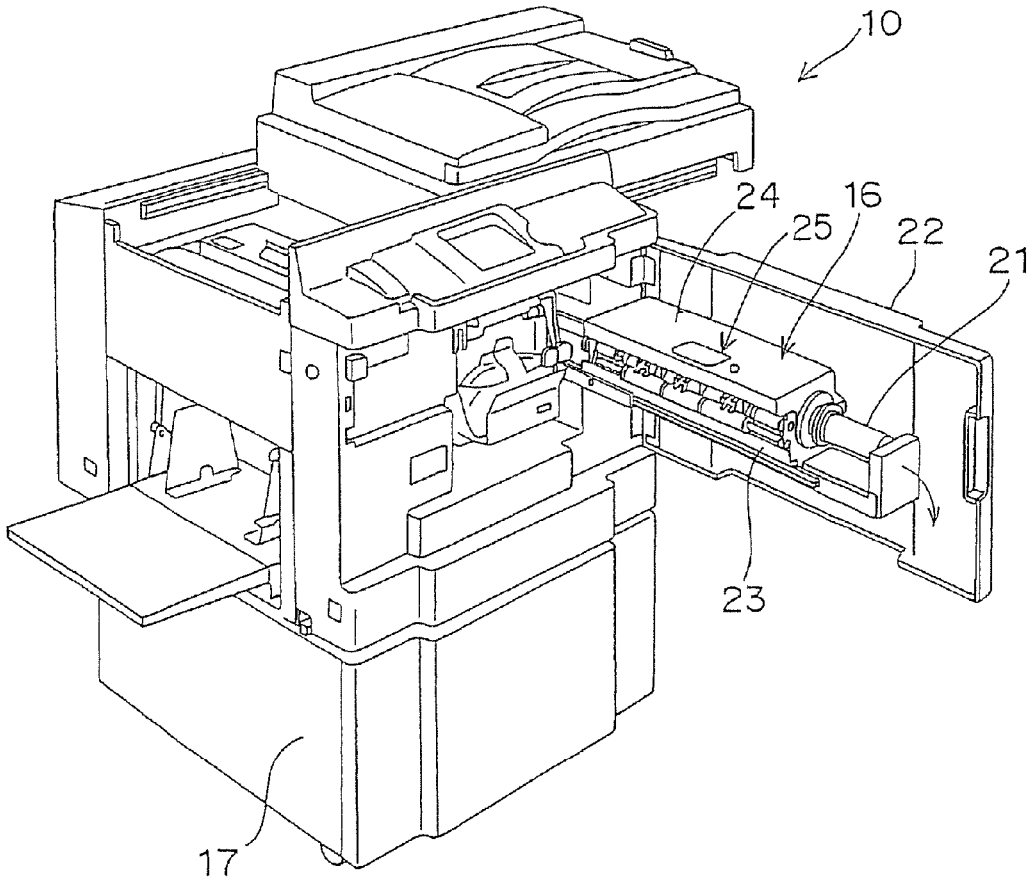
FIG. 8 is a perspective view of a stencil printing machine in accordance with yet another embodiment of the present invention.

(2) As shown in FIG. 8, the stencil printing machine 10 may be configured such that the freely openable/closable door 22 is provided on the front side and the plate ejecting device 16 can be taken out by sliding it outward, in a state where the door 22 is opened.

What is claimed is:

1. A stencil printing machine comprising, in a casing thereof, a plate ejecting device for stripping a used stencil sheet from a stencil plate mounting body and collecting the stencil sheet, wherein the plate ejecting device comprises:

a storage section for storing the stencil sheet, a lid body for closing the storage section openably and closably; and a bolting means for bolting the lid body in a closed state, the bolting means having a locking mechanism for locking the lid body to be in the closed state and a bolting section for bolting the lid body by maintaining a locked state by means of the locking mechanism, and wherein the plate ejecting device is provided so as to be externally removable from the casing, and wherein the locking mechanism has an engaged member built in the storage section and an engaging member provided in the lid body, and makes the lid body be in the locked state by making the engaging member engage with the engaged member, and wherein the bolting section keeps the locked state by the locking mechanism, by means of regulating the engaging member.

* * * * *